US010109442B2

(12) United States Patent
Zacherl

(10) Patent No.: US 10,109,442 B2
(45) Date of Patent: Oct. 23, 2018

(54) ELECTROMECHANICAL CIRCUIT BREAKER FOR A BATTERY DISTRIBUTION BOX OF A MOTOR VEHICLE AND BATTERY DISTRIBUTION BOX

(71) Applicant: Lisa Draexlmaier GmbH, Vilsbiburg (DE)

(72) Inventor: Christian Zacherl, Dorfen (DE)

(73) Assignee: Lisa Draexlmaier GmbH, Vilsbiburg (DE)

( * ) Notice: Subject to any disclaimer, the term of this patent is extended or adjusted under 35 U.S.C. 154(b) by 0 days.

(21) Appl. No.: 15/664,559

(22) Filed: Jul. 31, 2017

(65) Prior Publication Data

US 2018/0033575 A1 Feb. 1, 2018

(30) Foreign Application Priority Data

Aug. 1, 2016 (DE) ..... 10 2016 114 176

(51) Int. Cl.
*H01H 50/20* (2006.01)
*H01H 50/02* (2006.01)
*H01H 47/22* (2006.01)

(52) U.S. Cl.
CPC ..... *H01H 50/20* (2013.01); *H01H 47/22* (2013.01); *H01H 50/021* (2013.01)

(58) Field of Classification Search
CPC ..... H01H 50/20; H01H 50/021; H01H 47/22
See application file for complete search history.

(56) References Cited

U.S. PATENT DOCUMENTS

| | | | | |
|---|---|---|---|---|
| 9,642,670 | B2 * | 5/2017 | Johnson | A61B 18/1206 |
| 2004/0100347 | A1 * | 5/2004 | Okamoto | H01F 1/344 336/83 |
| 2013/0027833 | A1 * | 1/2013 | Rabe | H01F 7/1646 361/206 |
| 2017/0270071 | A1 * | 9/2017 | Fan | G06F 13/4282 |

FOREIGN PATENT DOCUMENTS

| | | |
|---|---|---|
| DE | 199 46 735 C1 | 4/2001 |
| DE | 10 2004 056 305 A1 | 7/2005 |
| DE | 10 2014 014 925 A1 | 4/2016 |

OTHER PUBLICATIONS

Office Action in German Application No. DE 10 2016 114 176.3, dated Apr. 6, 2017.
Decision to Grant in German Application No. DE 10 2016 114 176.3, dated Oct. 11, 2017.

* cited by examiner

*Primary Examiner* — Scott Bauer
(74) *Attorney, Agent, or Firm* — Finnegan, Henderson, Farabow, Garrett & Dunner LLP

(57) ABSTRACT

Embodiments of the present disclosure provide an electromechanical circuit breaker for a battery distribution box of a motor vehicle. The electromechanical circuit breaker comprises a housing having a coil arranged therein. To switch the electromechanical circuit breaker, the coil is actuated via a control terminal. The electromechanical circuit breaker includes a common load choke arranged inside the housing.

20 Claims, 2 Drawing Sheets

ELECTROMECHANICAL CIRCUIT BREAKER FOR A BATTERY DISTRIBUTION BOX OF A MOTOR VEHICLE AND BATTERY DISTRIBUTION BOX

CROSS REFERENCE TO RELATED APPLICATION

This application is based upon and claims the benefit of prior German Patent Application No. 10 2016 114 176.3, filed on Aug. 1, 2016, the entire contents of which are incorporated herein by reference.

TECHNICAL FIELD

The present disclosure relates to an electromechanical circuit breaker for a battery distribution box of a motor vehicle and to a corresponding battery distribution box.

BACKGROUND

Hybrid vehicles, plug-in, purely electrical vehicles, fuel cell vehicles, and battery charging systems generally use voltages in excess of 60 V. In some jurisdictions, battery-operated vehicles are required by law to be equipped with protective devices such as fuses, circuit breakers or main contactors if the rechargeable power storage systems are susceptible to overheating by an overload current. These protective devices isolate the power storage unit safely from the high-voltage circuit in the event of a current overload, regardless of circuit's current direction. Corresponding electromechanical circuit breakers are known and are often referred to as relays, high-voltage contactor or simply contactor. The basic function of these types of circuit breakers is switching high electrical output in a load circuit with the aid of a comparatively small current, i.e. a control current. A circuit breaker of this type generally comprises two electrical contacts that are closed or connected by a movable contact. The movable contact is moved between an inactive position and a switching position by an armature guided via a coil and in the coil.

The German patent application DE 10 2015 224 658, the entire contents of which are incorporated herein by reference, describes an electromechanical circuit breaker with two pairs of contacts, with one contact of each contact pair being arranged in spaced relationship on a contact bridge.

Modern electric vehicles utilize an onboard voltage in excess of 400 V, for instance 480 V. Large currents are transferred from the battery to the actuators that are to be switched by the electromechanical circuit breakers. Known circuit breakers suffer from various drawbacks, such as their coupling attenuation. Prior art systems attempt to combat coupling attenuation in the control device that triggers the circuit breaker, which allows the interference to spread through additional couplings.

SUMMARY

Embodiments of the present disclosure provide an electromechanical circuit breaker that enhances the electromagnetic compatibility.

Embodiments of the present disclosure provide an electromechanical circuit breaker for a battery distribution box of a motor vehicle. The electromechanical circuit breaker comprises a coil with an armature in a housing to switch a high-voltage load circuit by a movement of the armature. In some embodiments, a control terminal is electrically coupled to the coil, through which the electromechanical circuit breaker is actuated. A common mode choke may be arranged inside the housing of the circuit breaker. The common mode choke may be positioned between the coil and one of the external terminals of the electromechanical circuit breaker, such that the common mode choke is electrically connected to the coil.

According to embodiments of the present disclosure, a battery distribution box may also be referred to as a battery junction box. The battery distribution box is designed to distribute the power (current/voltage) provided by an electrical power storage unit to connected loads, with the connections being switchable via circuit breakers. An electromechanical circuit breaker may be understood to be a contactor or a high-voltage contactor. In some embodiments, the circuit breaker has at least two circuits: a control circuit and a main circuit. The control circuit serves to control (i.e. to switch on and off) the contactor, and the main circuit is the circuit that is switched. A common mode choke may be understood to be a suppressor choke, a common mode suppressor choke or a current-compensated choke. Common mode chokes may also abbreviated as CMC or simply referred to as a "choke."

According to embodiments of the present disclosure, a common mode choke may be used to reduce or completely filter out parasitic currents from the high-voltage grid or interference emissions occurring in the coil of the circuit breaker in the direction of the control device that actuates the circuit breaker, to improve the electromagnetic compatibility. Further, the circuit breaker may occupy the same installation space and the common load choke can be mounted in a pre-existing space.

According to embodiments of the present disclosure, a conductor coupling the coil to the common load choke may have a maximum length of 5 cm. The inductivity of the current conductor may be increased by approximately one microhenry per centimeter (pH/cm). In some embodiments, the conductor has a maximum length of 2 cm, or a maximum length of 1 cm. In some embodiments the length of the conductor is less than 5 mm. This can be achieved by arranging the common mode choke inside the housing of the circuit breaker.

According to embodiments of the present disclosure, a switching voltage in the main circuit of the electromechanical circuit breaker may be at least 400 V. Thus, the electromechanical circuit breaker is well-suited for use in automotive applications such as electric vehicles due to the circuit breaker's switching performance. For example, a minimum of 480 V, or 800 V, may be switched in the main circuit. Here, a switching current of several 100 A can be switched. For example, a switching current of the electromagnetic circuit breaker may amount to at least 200 A, or to at least 500 A. In one embodiment, the switching current may amount to 1000 A, or to at least 2000 A.

In one embodiment of the present disclosure, the common mode choke is arranged on an outer side of the housing in a plug connector for the control terminal (rather than inside the housing). In this way, circuit breakers may be retrofitted with a common load suppressor.

According to embodiments of the present disclosure, the plug connector may have two plug elements. One element may be designed as a socket and the other element as the corresponding plug. In one embodiment, the common load choke here may be arranged in a first plug element that is connected to the housing. In another embodiment, the common load choke may be arranged in a second plug element. The second plug element may be equipped for connection to the control device through an electric line or a wiring harness and for electrically coupling the control device to the circuit breaker in interaction with the first plug element. Thus, a common load choke can be combined with a circuit breaker without altering the circuit breaker.

According to embodiments of the present disclosure, in order to have a high impedance in as broad a frequency spectrum as possible, such as 100 MHz or up to 200 MHz, the common load choke may have a plurality of suppressor chokes. To achieve the high inductivity necessary for this while simultaneously maintaining a low parasitic self-capacitance, at least two suppressor chokes of the plurality of suppressor chokes may have different properties.

According to embodiments of the present disclosure, the common load choke and an additional protective circuit may be arranged on a common circuit board, to save additional installation space and/or enhance the electromagnetic compatibility or lower interference emissions. A protective circuit may include a free-wheeling diode, a capacitor or a combination of a free-wheeling diode and capacitor used in a circuit.

Embodiments of the present disclosure provide a battery distribution box for a motor vehicle. The battery distribution box may comprise an embodiment of the electromechanical circuit breaker described above. In some embodiments, this allows for a reduced installation space with increased electromagnetic compatibility, since corresponding interference emissions may have a negative impact, for example on electronic components of the control device.

The described properties of the present disclosure and the manner in which these are achieved will be described in more detail based on the following detailed description. The foregoing general description and the following detailed description are exemplary and explanatory only, and are not restrictive of embodiments consistent with the present disclosure. Further, the accompanying drawings illustrate embodiments of the present disclosure, and together with the description, serve to explain principles of the present disclosure. The accompanying drawings shall only be regarded to be of a schematic, exemplary nature, and not as being true to scale. In the drawings, the same or similar elements are provided with the same reference numbers.

DETAILED DESCRIPTION

Figure 1:
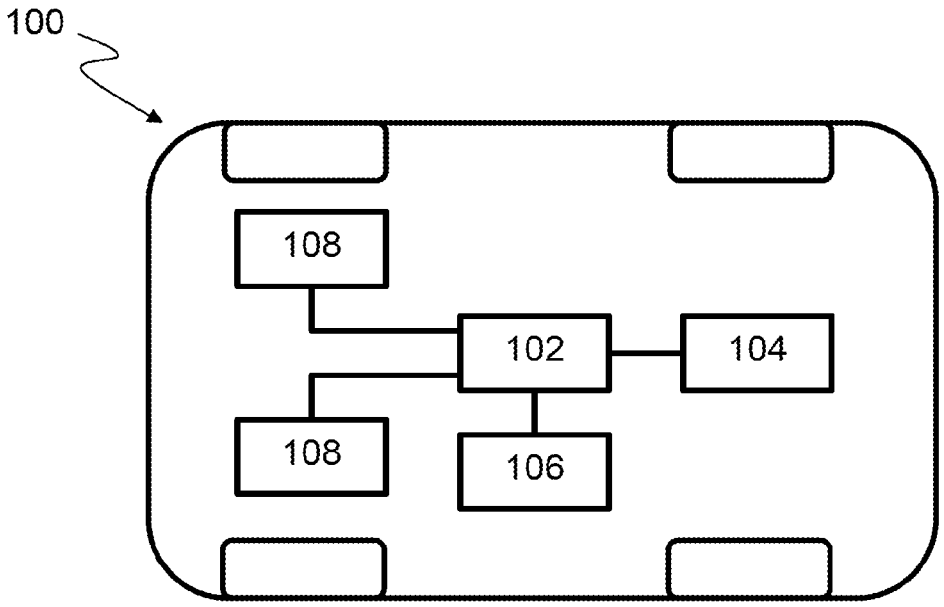
FIG. 1 is a schematic drawing of a motor vehicle with a battery distribution box according to an embodiment of the present disclosure.

FIG. 1 shows a motor vehicle 100 with a battery distribution box 102 coupled to a power storage unit 104, a central vehicle control device 106 and two loads 108. This simplified drawing of an onboard electrical system illustrates the basic functionality of a battery distribution box. The loads 108 may be actuators 108 such as drive motors of the vehicle 108 or other consumers such as air conditioning, lighting or the like. The loads 108 are switched on and off through commands transmitted from the central vehicle control device 106 to the battery distribution box 102. Accordingly, the battery distribution box 102 has electromechanical circuit breakers and a control device, as shown in FIG. 2.

Figure 2:
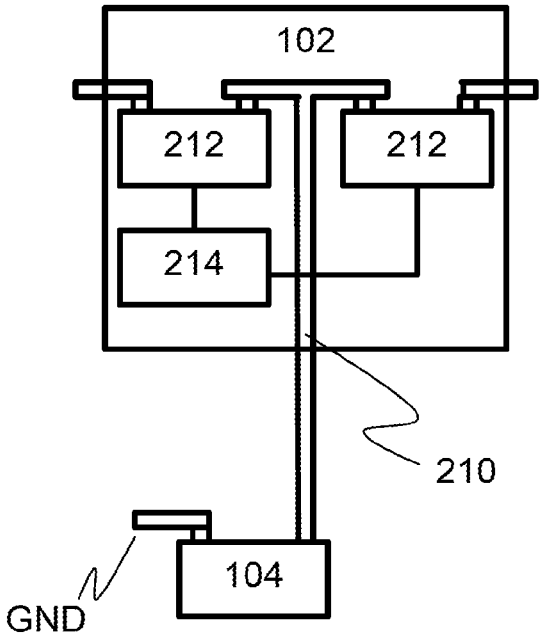
FIG. 2 is a schematic drawing of a battery distribution box according to an embodiment of the present disclosure.

FIG. 2 shows a schematic drawing of a battery distribution box 102 according to an embodiment of the present disclosure. The battery distribution box 102 includes busbars 210, two electromechanical circuit breakers 212 and a control device 214. A first contact of the power storage unit 104 is connected to ground GND and a second contact is connected through a busbar 210 to the battery distribution box 102. A busbar 210 extends in the battery distribution box 102 from the terminal leading to the power storage unit 104 to a particular first contact of the circuit breakers 212. An additional contact of the circuit breakers 212 is electrically connected via a busbar to a terminal for a load. The circuit breakers 212 are designed to conduct, or in other words, to switch, the current provided by the power storage unit 104 to the loads. Thus, the circuit breakers 212 are connected to the control device 214 in order to receive control signals from the control device 214 to actuate the circuit breakers 212.

In the embodiment shown in FIG. 2, the power storage unit provides a nominal voltage of at least 400 V, and preferably 480 V. The actual voltage made available may depend on the charge state and on the battery management system, and therefore may fluctuate within a tolerance range. The control device 214 typically works with 12 V onboard voltage.

With reference to the coupling attenuation, the main coupling path is the high-voltage contactor, i.e. the electromechanical circuit breaker 212. To minimize the coupling attenuation, the electromechanical circuit breaker 212 has a common load choke. This will be shown and explained in greater detail with reference to the following figures.

Figure 3:
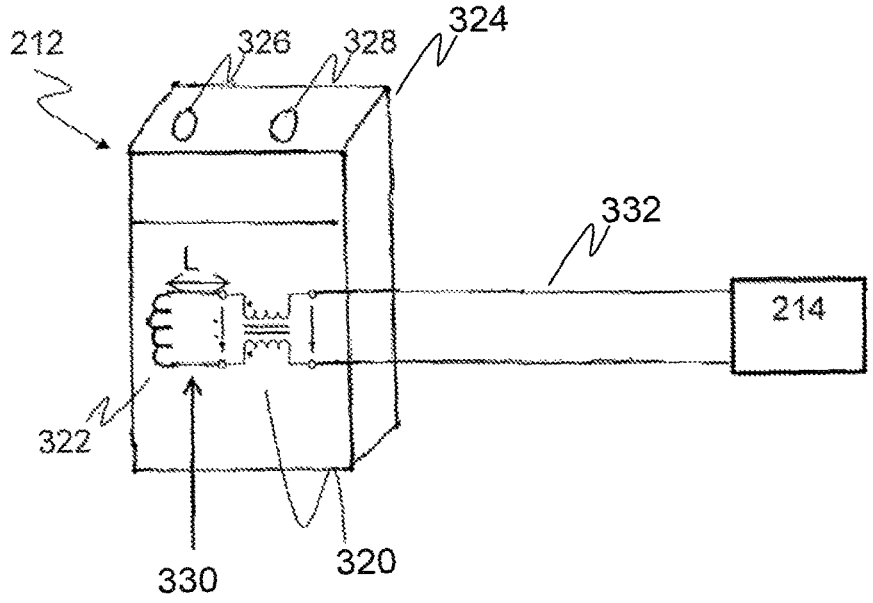
FIG. 3 is a schematic drawing of an electromechanical circuit breaker according to an embodiment of the present disclosure.

FIG. 3 shows an electromechanical circuit breaker 212 and a control device 214 connected to the circuit breaker 212, which includes a common load choke 320. Not shown in the drawing is the control device 214 being supplied from a low-voltage onboard electrical system, typically the 12 V onboard network of the vehicle.

The electromechanical circuit breaker 212, also referred to as high-voltage contactor 212, has a coil 322 that switches two high-voltage (HV) contacts 326, 328 arranged on a housing 324, via an armature (not shown in FIG. 3). Accordingly, in the activated state the two HV contacts 326, 328 are interconnected. Both the coil 322 with its armature and the common load choke 320 are arranged inside the housing 324.

The coil 322 is connected to the control device 214 via conductors 330, 332, with the common load choke 320 being connected therebetween. As depicted in FIG. 3, the conductor between the coil 322 and the common load choke 320 has reference number 330, and the conductor between the common load choke 320 and the control device 214 has reference number 332. A conductor 330, 332 may be understood to be a double cable made up of two electrical conductors. In one embodiment, the electrical conductors of the current conductor 330, 332 are twisted.

The length L of the line of the conductor 330 between the coil 322 and the common load choke 320 may be less than 5 cm, and in some embodiments may be less than 2 cm. In the embodiment shown in FIG. 3, the length L of the line is less than 1 cm. In some embodiments, a line length of less than 0.5 cm, with a view toward reducing the coupling attenuation, may be mechanically feasible. Thus, the interference is attenuated very closely to the source and prevents an additional coupling on the 12 V side.

Integrating the common load choke 320 inside the housing 324 as shown in FIG. 3 utilizes existing installation space that either cannot be created outside of the circuit breaker 212, or only with great constructional effort inside a battery distribution box. Further, it creates a damping effect to combat the problem of coupling attenuation.

The necessary installation space without a housing or circuit board for a single common load choke can be given as a cuboid with an edge length of approximately 6 mm. The base area needed may be increased if a plurality of suppressor chokes is combined on a circuit board to improve the impedance in a broad frequency spectrum, or if the common load choke 320 is combined with a wide protective circuit, however an edge length of 6 mm should still be adequate.

In some embodiments, an additional free-wheeling diode or a capacitor may be provided as the protective circuit. The free-wheeling diode protects the coil of the contactor. The capacitor brings an improvement in the frequency range. As an alternative, a protective circuit may also have a free-wheeling diode and a capacitor.

Figure 4:
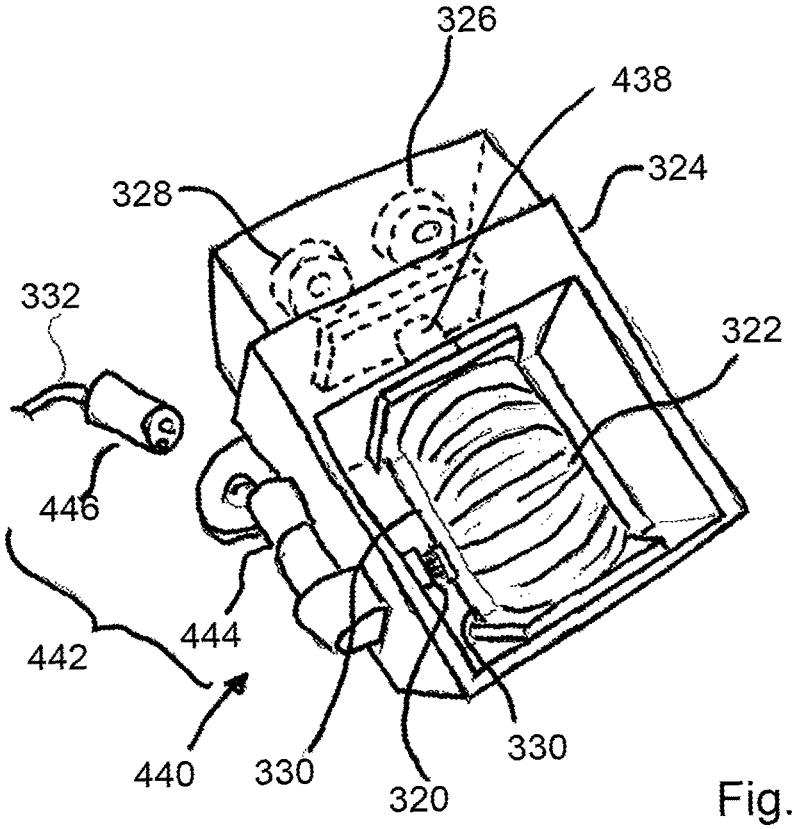
FIG. 4 is a drawing of electromechanical circuit breaker according to an embodiment of the present disclosure.

FIG. 4 illustrates the spatial arrangement of the common load choke 320. The circuit breaker 212 may be an embodiment of the circuit breaker 212 shown in FIGS. 2 and 3. An arrangement of the coil 322 is visible in the open housing 324. An armature 438 is arranged for movement inside the coil 322 in order to switch the HV contacts of the circuit breaker.

A control terminal 440 is provided on a side of the housing 324. The control terminal 440 is mechanically implemented as a plug connection 442. The plug connection 442 is comprised of a first plug element 444 and a second plug element 446. The first plug element 444 in the embodiment shown in FIG. 4 is a plug that is mechanically connected to the housing 324. The second plug element 446 is a socket that is electrically and mechanically connected to a line 332, and can be coupled to the control device. In some embodiments, the plug and socket can be interchanged with one another, or the plug connection can be implemented in a different manner such as with bifurcated contacts or the like.

In one embodiment, the common load choke 320 is arranged on the inner side of the housing 324 on the same housing wall as the plug connection 442, with the plug connection arranged on the outer side of the same housing wall.

In another embodiment, the common load choke 320 is arranged in one of the two plug elements 444, 446. This makes it possible to retrofit circuit breakers 212 without having to completely reconstruct or open them.

Having described aspects of the present disclosure in detail, it will be apparent that modifications and variations are possible without departing from the scope of aspects of the present disclosure as defined in the appended claims. As various changes could be made in the above constructions, products, and methods without departing from the scope of aspects of the present disclosure, it is intended that all matter contained in the above description and shown in the accompanying drawings shall be interpreted as illustrative and not in a limiting sense.

LIST OF REFERENCE NUMBERS

100 vehicle
102 battery distribution box
104 power storage unit
106 vehicle control device
108 load, actuator
210 busbar
212 electromechanical circuit breaker, high-voltage contactor
214 control device
320 common load choke
322 coil
324 housing
326, 328 HV contact
330, 332 conductor, cable
438 armature
440 control terminal
442 plug connector
444 first plug element
446 second plug element
L length, line length

What is claimed is:

1. An electromechanical circuit breaker for a battery distribution box of a motor vehicle, the electromechanical circuit breaker comprising:

a housing;

a coil having an armature arranged in the housing;

a control terminal arranged on a side of the housing, the control terminal configured to actuate the coil such that a movement of the armature switches the electromechanical circuit breaker; and a common load choke electrically connected to the coil, wherein the common load choke is configured to reduce coupling attenuation.

2. The electromechanical circuit breaker according to claim 1, comprising:

a first conductor electrically coupling the coil to the common load choke, wherein the first conductor has a maximum length (L) of 5 cm.

3. The electromechanical circuit breaker according to claim 2, wherein the first conductor has a maximum length (L) of 2 cm.

4. The electromechanical circuit breaker according to claim 1, wherein a switching voltage of the electromechanical circuit breaker is at least 400 V.

5. The electromechanical circuit breaker according to claim 1, wherein the common load choke is arranged inside the housing.

6. The electromechanical circuit breaker according to claim 5, wherein the common load choke is arranged on an inner side of the housing and the control terminal is arranged on an outer side of the same side of the housing.

7. The electromechanical circuit breaker according to claim 1, wherein the control terminal includes a plug connector and the common load choke is arranged in the plug connector.

8. The electromechanical circuit breaker according to claim 7, wherein:

the plug connector comprises a first plug element connected to the housing; and the common load choke is arranged in the first plug element.

9. The electromechanical circuit breaker according to claim 7, wherein:

the plug connector comprises a second plug element connected to a second conductor configured to connect the electromechanical circuit breaker to a control device; and the common load choke is arranged in the second plug element.

10. The electromechanical circuit breaker according to claim 1, wherein the common load choke includes a plurality of suppressor chokes, at least two of the plurality of suppressor chokes having different properties.

11. The electromechanical circuit breaker according to claim 1, comprising:

a common circuit board, wherein the common load choke and a protective circuit are arranged on the common circuit board.

12. The electromechanical circuit breaker according to claim 11, comprising: protective circuit comprises at least one of a free-wheeling diode and a capacitor.

13. The electromechanical circuit breaker according to claim 1, comprising:

a control device configured to transmit control signals to the control terminal causing the coil to actuate.

14. A battery distribution box for a motor vehicle, comprising:

an electromechanical circuit breaker including:

a housing;

a coil having an armature arranged in the housing;

a control terminal arranged on a side of the housing, the control terminal configured to actuate the coil such that a movement of the armature switches the electromechanical circuit breaker; and a common load choke electrically connected to the coil, wherein the common load choke is configured to reduce coupling attenuation; and a control device connected to the electromechanical circuit breaker, the control device configured to transmit control signals to the control terminal causing the coil to actuate.

15. An electromechanical circuit breaker for a battery distribution box of a motor vehicle, the electromechanical circuit breaker configured to conduct current from a power storage device to one or more loads when switched, the electromechanical circuit breaker comprising:

a housing;

at least two contacts arranged on a side of the housing;

a coil having an armature arranged in the housing, wherein a movement of the armature is configured to interconnect the two contacts when the coil is actuated;

a common load choke arranged inside the housing, the common load choke being electrically connected to the coil; and a control terminal arranged on a side of the housing, wherein the control terminal is configured to actuate the coil and switch the electromechanical circuit breaker.

16. The electromechanical circuit breaker according to claim 15, comprising:

a first conductor electrically coupling the coil to the common load choke, wherein the first conductor has a maximum length (L) of 5 cm.

17. The electromechanical circuit breaker according to claim 16, wherein the first conductor has a maximum length (L) of 2 cm.

18. The electromechanical circuit breaker according to claim 15, wherein the common load choke includes a plurality of suppressor chokes, at least two of the plurality of suppressor chokes having different properties.

19. The electromechanical circuit breaker according to claim 15, wherein:

the control terminal comprises a first plug element coupled to the side of the housing and configured to interconnect with a second plug element, the second plug element connecting the electromechanical circuit breaker to a control device.

20. The electromechanical circuit breaker according to claim 15, comprising:

a common circuit board, wherein the common load choke and a protective circuit are arranged on the common circuit board.

* * * * *